United States Patent [19]

Inaga et al.

[11] 4,446,822

[45] May 8, 1984

[54] HEAT INSULATING MOUNTING DEVICE FOR CARBURETOR

[75] Inventors: Hisashi Inaga, Tokyo; Yoetsu Yokocho, Tachikawa, both of Japan

[73] Assignee: Kioritz Corporation, Tokyo, Japan

[21] Appl. No.: 372,278

[22] Filed: Apr. 27, 1982

[30] Foreign Application Priority Data

May 25, 1981 [JP] Japan ..... 56-74614[U]

[51] Int. Cl.³ ..... F02B 77/11

[52] U.S. Cl. ..... 123/41.31; 123/195 C; 123/543

[58] Field of Search ..... 123/41.31, 543, 195 C, 123/548

[56] References Cited

U.S. PATENT DOCUMENTS

| | | | |
|---|---|---|---|
| 930,596 | 8/1909 | Hanks | 123/195 C |
| 2,635,597 | 4/1953 | Boyce | 123/41.31 |
| 3,118,433 | 1/1964 | Lechtenberg | 123/41.31 |
| 3,285,588 | 11/1966 | Huddle | 123/543 |
| 3,332,476 | 7/1967 | McDougal | 123/41.31 |
| 3,542,095 | 11/1970 | Frederickson . | |
| 3,612,022 | 10/1971 | Von Bomhard . | |
| 4,099,496 | 7/1978 | Nagase | 123/41.31 |
| 4,303,401 | 12/1981 | Sanmi | 123/41.31 |

FOREIGN PATENT DOCUMENTS

| | | | |
|---|---|---|---|
| 885152 | 12/1961 | United Kingdom | 123/41.31 |

*Primary Examiner*—Ronald H. Lazarus

*Attorney, Agent, or Firm*—Karl W. Flocks; A. Fred Starobin; Sheridan Neimark

[57] ABSTRACT

A heat insulating mounting device for use with a carburetor of an internal combustion engine including a heat insulating casing formed of a heat insulating synthetic resinous material for enclosing the carburetor connected to a cylinder in a manner to isolate the carburetor from the heat of radiation of the engine, and a flexible air passageway of small thickness formed of a heat insulating high molecular compound of rubbery properties heat insulatingly communicating the carburetor with the cylinder.

1 Claim, 3 Drawing Figures

HEAT INSULATING MOUNTING DEVICE FOR CARBURETOR

BACKGROUND OF THE INVENTION

This invention relates to a heat insulating mounting device suitable for use in mounting a carburetor on the engine.

In a small portable power working machine driven by an engine as a power source, it often happens that the engine slows down or comes to a halt at last when the operation is performed intermittently, not continuously. When this is the case, a fan for cooling the cylinder of the engine has its ability lowered or becomes inoperative, causing an abrupt rise in the temperature of the engine. This might result in the heat of radiation of the cylinder acting on the carburetor body and causing the heat to be transferred through the carburetor mounting structure. Thus the carburetor would have its temperature rise and the fuel therein would undergo overvaporization. This would cause vapor lock in the fuel passageway and make it impossible to start the engine when an attempt is made to bring about engine start up in a short period of time. This is well know.

SUMMARY OF THE INVENTION

This invention has been made for the purpose of obviating the aforesaid disadvantage of the prior art. Accordingly the invention has as its object the provision of a heat insulating mounting device for a carburetor capable of positively preventing transfer of heat to the carburetor from the engine of a working machine of the type described to thereby avoid an inordinate rise in the temperature of the carburetor.

The outstanding characteristic of the invention is that the carburetor is enclosed by a heat insulating casing formed at a heat insulating synthetic resinous material and connected to the cylinder in a manner to isolate the carburetor from the heat of radiation of the engine, and the carburetor is heat insulatingly communicated with the cylinder through a flexible air passageway of small thickness formed of a heat insulating high molecular compound of rubbery properties.

DESCRIPTION OF THE PREFERRED EMBODIMENT

Figure 1:
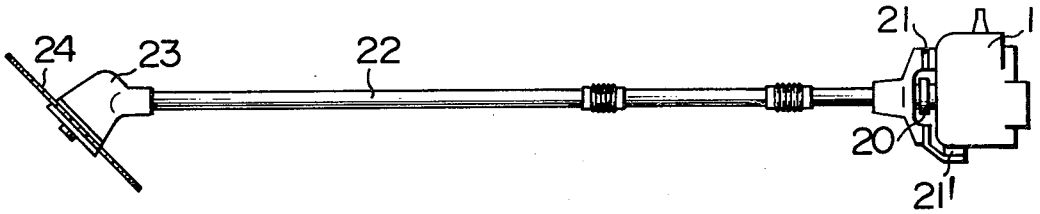
FIG. 1 is an external view of a grass trimmer equipped with an engine.
Figure 3:
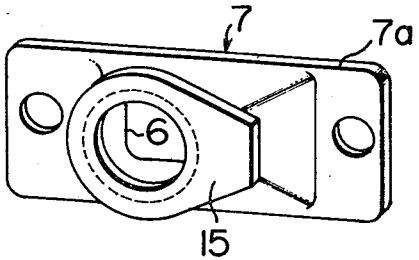
FIG. 3 is a perspective view of the flexible air passageway of small thickness.
Figure 2:
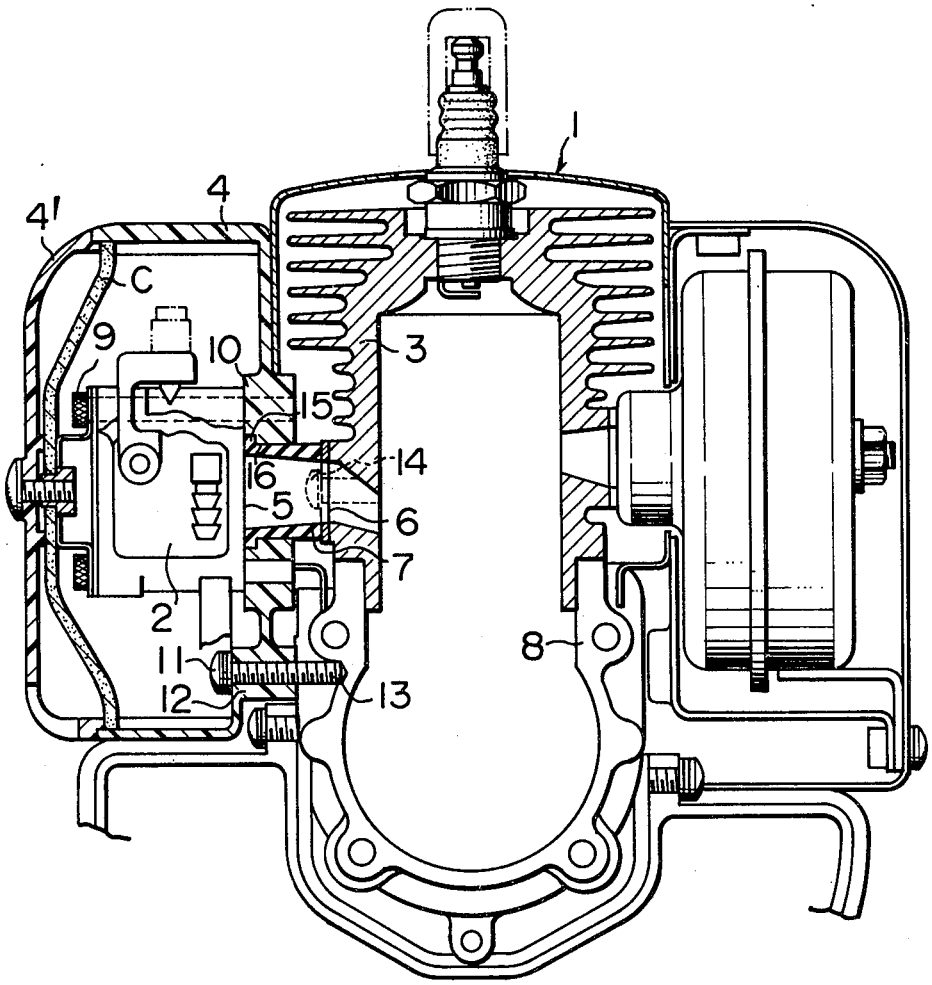
FIG. 2 is a fragmentary sectional view of an engine mounting a carburetor by using the heat insulating mounting device according to the invention.

FIG. 1 is a view of a grass trimmer in its entirety shown as one example of a small working machine equipped with an engine; FIG. 2 is a sectional view showing the essential portions of the cylinder of the engine of the grass trimmer and the carburetor; and FIG. 3 is a perspective view of the air passageway tube communicating the carburetor with the cylinder.

In the embodiment shown and described herein, the small type power working machine is shown and described as a grass trimmer wherein a main rod 22 has connected to one end thereof a rotary blade 24 through a gear box 23 and to the other end thereof an engine 1 through a vibration damping member 21 and 21'. The main rod 22 has in its interior a power transmitting shaft, not shown, connected with the engine 1 through a centrifugal clutch 20. The invention is directed to a heat insulating mounting device suitable for use in heat insulating mounting the carburetor of the engine of the small type power working machine of the aforesaid type.

FIG. 2 shows a cylinder 3 and a carburetor 2 in mounting relation to each other. The carburetor 2 is enclosed by a heat insulating casing 4 of a heat insulating synthetic resinous material and secured to a casing boss 10 by bolts 9. The casing 4 is assembled with the engine 1 as a unit by a bolt 11 threadably connected to a portion of a crank case 8 through a casing boss 12. The casing 4 has an air-permeable casing lid 4' and a filter C attached to its open end to thereby enclose the carburetor. Thus the carburetor 2 is isolated from outside and thermally insulated.

The carburetor 2 is communicated with the engine cylinder 3 through a flexible air passageway 7 of small thickness formed of a heat insulating high polymer compound of rubbery properties. Before the heat insulating casing 4 for the carburetor 2 is attached to the crank case 8, the air passageway 7 is clamped by a bolt 14 to a suction port 6 (see FIG. 2) of the cylinder 3 at a bolt 14 to a suction port 6 (see FIG. 2) of the cylinder 3 at a mounting surface thereof which is reinforced by a sheet metal *7a* at one end thereof as shown in FIG. 3, to mount the air passageway 7 between the carburetor 2 and the cylinder 3. The air passageway 7 has at the other end thereof a flexible open end of small thickness formed with a flange 15. Thus the air passageway 7 can be fitted in an opening 16 of the heat insulating casing 4 by freely deforming the open end of small thickness and the flange 15 catches in the inner side of the heat insulating casing 4. Thereafter the heat insulating casing 4 is secured to the crank case 8 and the carburetor 2 is mounted in the casing 4. By securing the carburetor 2 in place, a mounting surface 5 of the carburetor 2 is pressed against the flange 15 in airtight relation, so that the casing 4 and the carburetor 2, the carburetor 2 and the cylinder 3 are mounted in overlapping relation. Thus the fuel-air mixture passage of the carburetor 2 is communicated with the suction port 6 of the cylinder 3 through the air passageway 7.

By virtue of the presence of the air passageway 7 of small thickness and small heat transfer crosssectional area which is formed of heat insulating material, transfer of heat from the cylinder 3 to the carburetor 2 can be prevented. Moreover, the carburetor 2 can be prevented from being heated by the heat generated by the engine 1 because it is mounted in the heat insulating casing 4, so that the carburetor 2 can be kept impervious to the heat generated by the engine 1. Thus the carburetor 2 mounted by using the heat insulating mounting device according to the invention can have its temperature reduced by about 10° C. as compared with carburetors of the prior art. This enables restart of the engine facilitated when the grass trimmer is intermittently operated, making it possible to perform operations with improved reliability. It will be appreciated that the invention can positively increase the performance of an engine of a small type power working machine by avoiding overheating of the carburetor, thereby contributing to popularization of this type of machine.

What is claimed is:

1. In an internal combustion engine including at least one engine cylinder, said engine having an engine well with an opening therethrough. In the passage through said opening of a mixture of air and fuel, said engine wall having a carburetor mounted adjacent thereto, the improvement comprising:

a heat insulating mounting device for mounting said carburetor adjacent said engine wall through heat insulating material, said heat insulating mounting device comprising a heat insulating casing and a separate air-permeable casing lid, said heat insulating mounting device surrounding said carburetor and extending between said wall of said engine and said carburetor, said casing being connected to said cylinder in a manner to isolate the carburetor from the heat of radiation of said engine, and a flexible air passageway of small thickness passing through said casing to form a heat insulating path for air and fuel between said carburetor and said opening through said engine wall, said flexible air passageway being surrounded by said casing and being formed of a heat insulating high molecular compound of rubbery properties.

* * * * *